US008076601B2

(12) United States Patent
Chu

(10) Patent No.: US 8,076,601 B2
(45) Date of Patent: Dec. 13, 2011

(54) INPUT KEY STRUCTURE FOR ELECTRONIC DEVICE

(75) Inventor: Yung-Hung Chu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 402 days.

(21) Appl. No.: 12/492,134

(22) Filed: Jun. 25, 2009

(65) Prior Publication Data

US 2010/0000848 A1 Jan. 7, 2010

(30) Foreign Application Priority Data

Jul. 2, 2008 (CN) ..... 2008 1 0302506

(51) Int. Cl.
*H01H 5/02* (2006.01)

(52) U.S. Cl. ..... 200/404; 335/207

(58) Field of Classification Search ..... 200/339, 200/400, 404; 335/151, 153, 205, 207
See application file for complete search history.

(56) References Cited

U.S. PATENT DOCUMENTS

| | | | | |
|---|---|---|---|---|
| 3,261,944 | A * | 7/1966 | Sherwood | 335/78 |
| 3,950,719 | A * | 4/1976 | Maxwell | 335/205 |
| 4,489,297 | A * | 12/1984 | Haydon et al. | 335/207 |
| 4,868,530 | A * | 9/1989 | Ahs | 335/207 |
| 6,369,692 | B1 * | 4/2002 | Van Zeeland | 338/200 |

FOREIGN PATENT DOCUMENTS

| | | |
|---|---|---|
| CN | 1578611 A | 2/2005 |
| CN | 2845346 Y | 12/2006 |

* cited by examiner

*Primary Examiner* — Xuong Chung Trans
(74) *Attorney, Agent, or Firm* — Altis Law Group, Inc.

(57) ABSTRACT

An input key structure for an electronic device includes a first magnetic body, a circuit board and a second magnetic body. The circuit board has a switch. The second magnetic body rotates relative to the first magnetic body to selectively locate between an initial position parallel with the second magnetic body and a target position contacted with the switch. The second magnetic body is structured to cooperate with the first magnetic body to generate a magnetic attractive force to automatically adjust the second magnetic body to the initial position when the second magnetic body is rotated away from its initial position to the target position.

13 Claims, 5 Drawing Sheets

INPUT KEY STRUCTURE FOR ELECTRONIC DEVICE

BACKGROUND

1. Technical Field

The present disclosure relates to input keys, and particularly to an input key structure for an electronic device.

2. Description of Related Art

A typical input key includes an input key cap, a switch, and a resilient member between the input key cap and the switch. The resilient member may be made of plastic material. When the input key cap is sufficiently pressed, a force is exerted on the resilient member, and the input key cap drives the switch to change from an open state to a close state. During this closed state, the resilient member is kept under tension by a restoring force. When the input key cap is pressed again, the restoring force is released, the input key cap returns to an initial position, and the switch changes from the close state to the open state. However, the restoring forces of the resilient member may be weakened after repeated use, thus the reliability of the electronic device decreases with use.

Therefore, there is room for improvement within the art; a new input key structure for portable electronic devices is desired.

DETAILED DESCRIPTION

Figure 1:
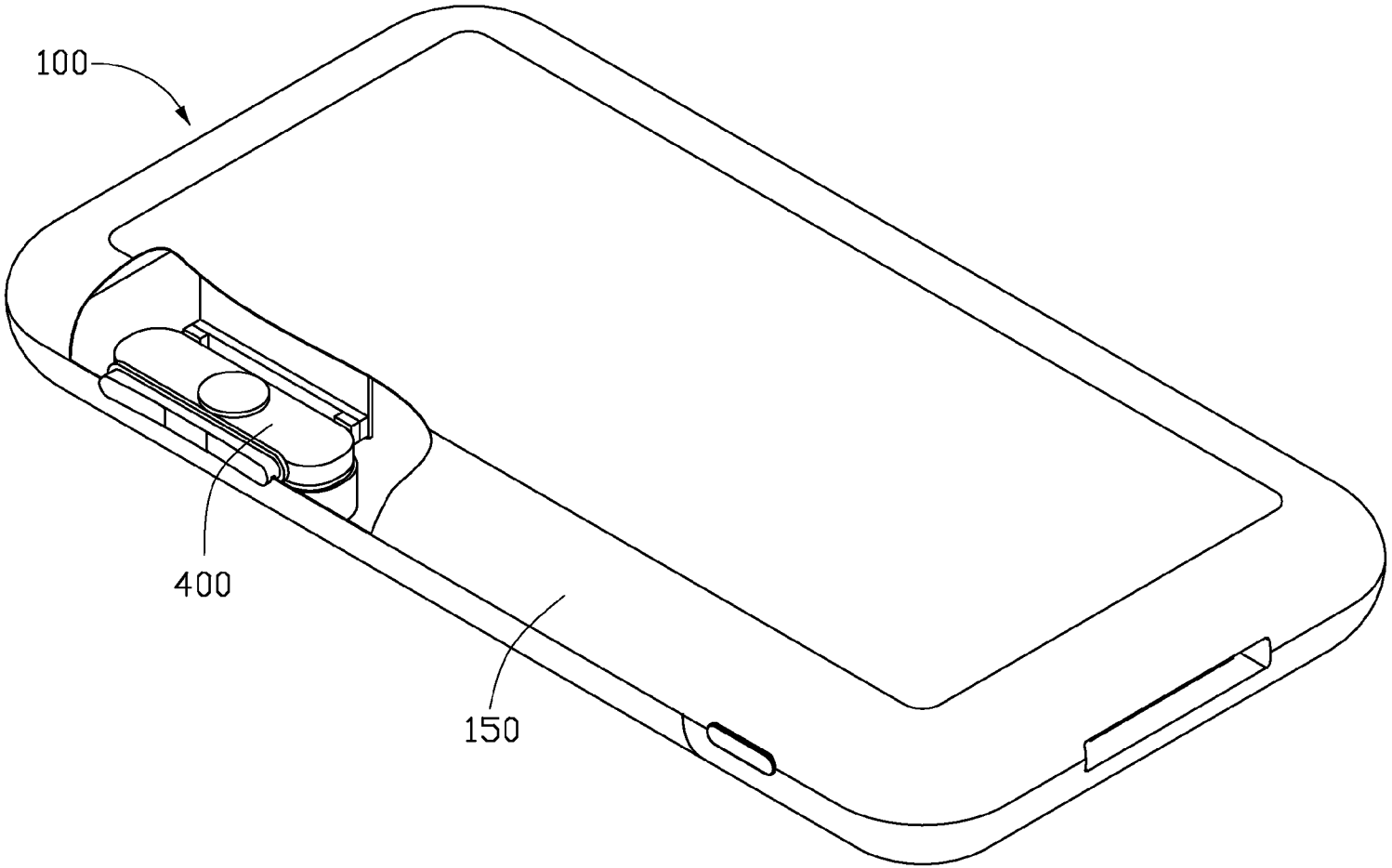
FIG. 1 is an isometric view of an electronic device in accordance with an exemplary embodiment.

Referring to FIG. 1, an electronic device 100, such as a mobile phone, includes a main body 150 and an input key structure 400 mounted in the main body 150.

Figure 2:
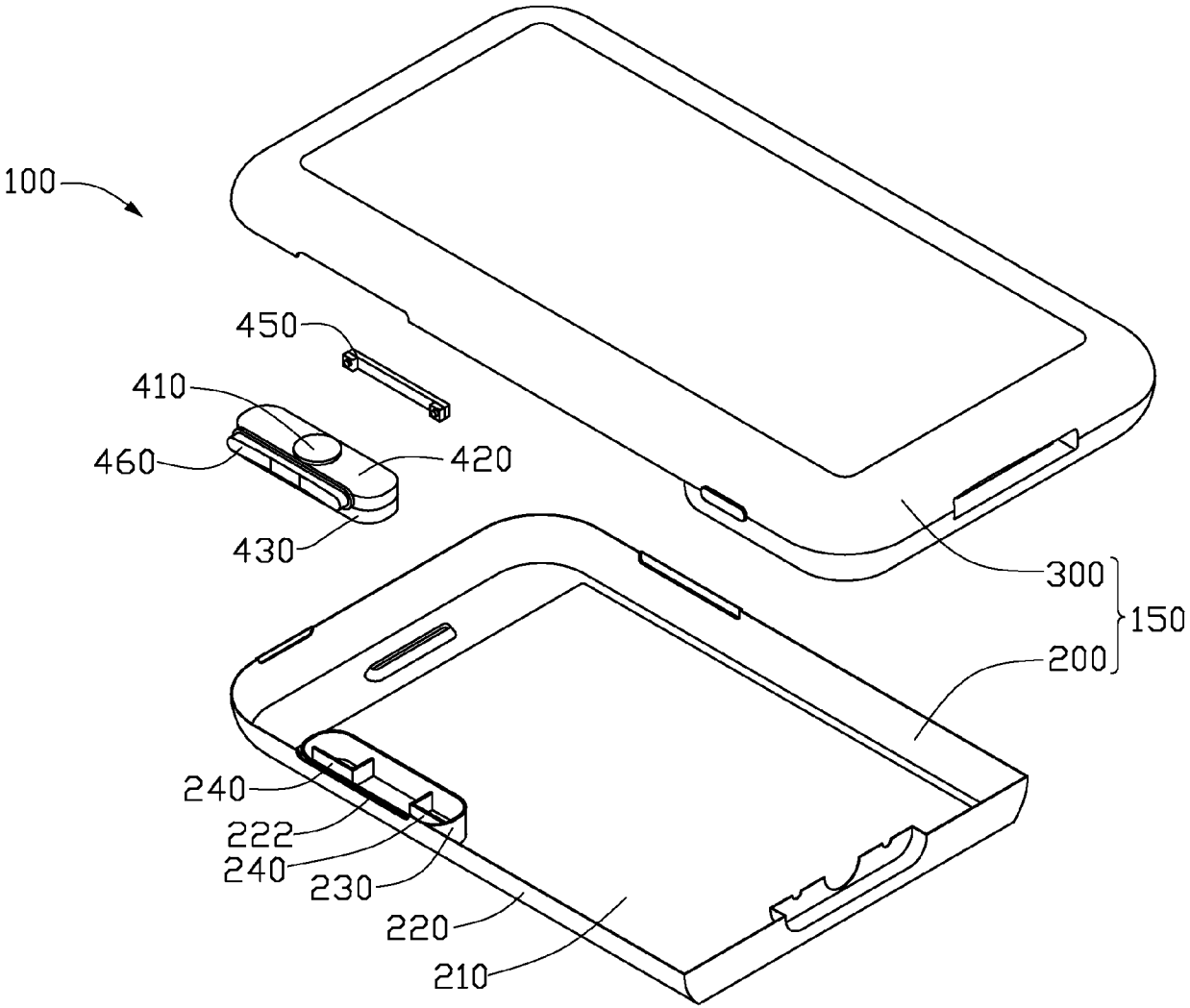
FIG. 2 is a partially exploded view of the electronic device in FIG. 1.
Figure 3:
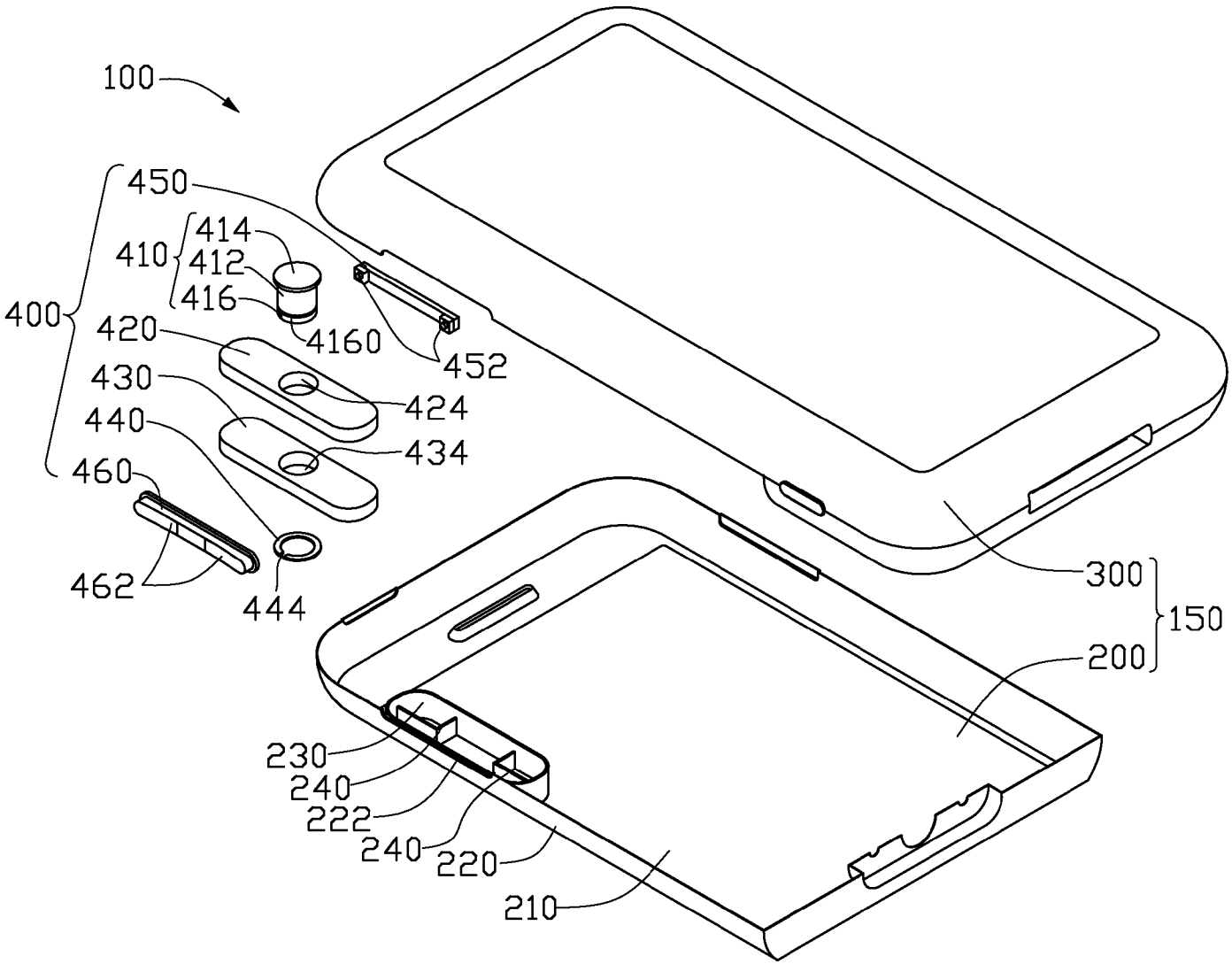
FIG. 3 is one completely exploded view of the electronic device in FIG. 1.
Figure 4:
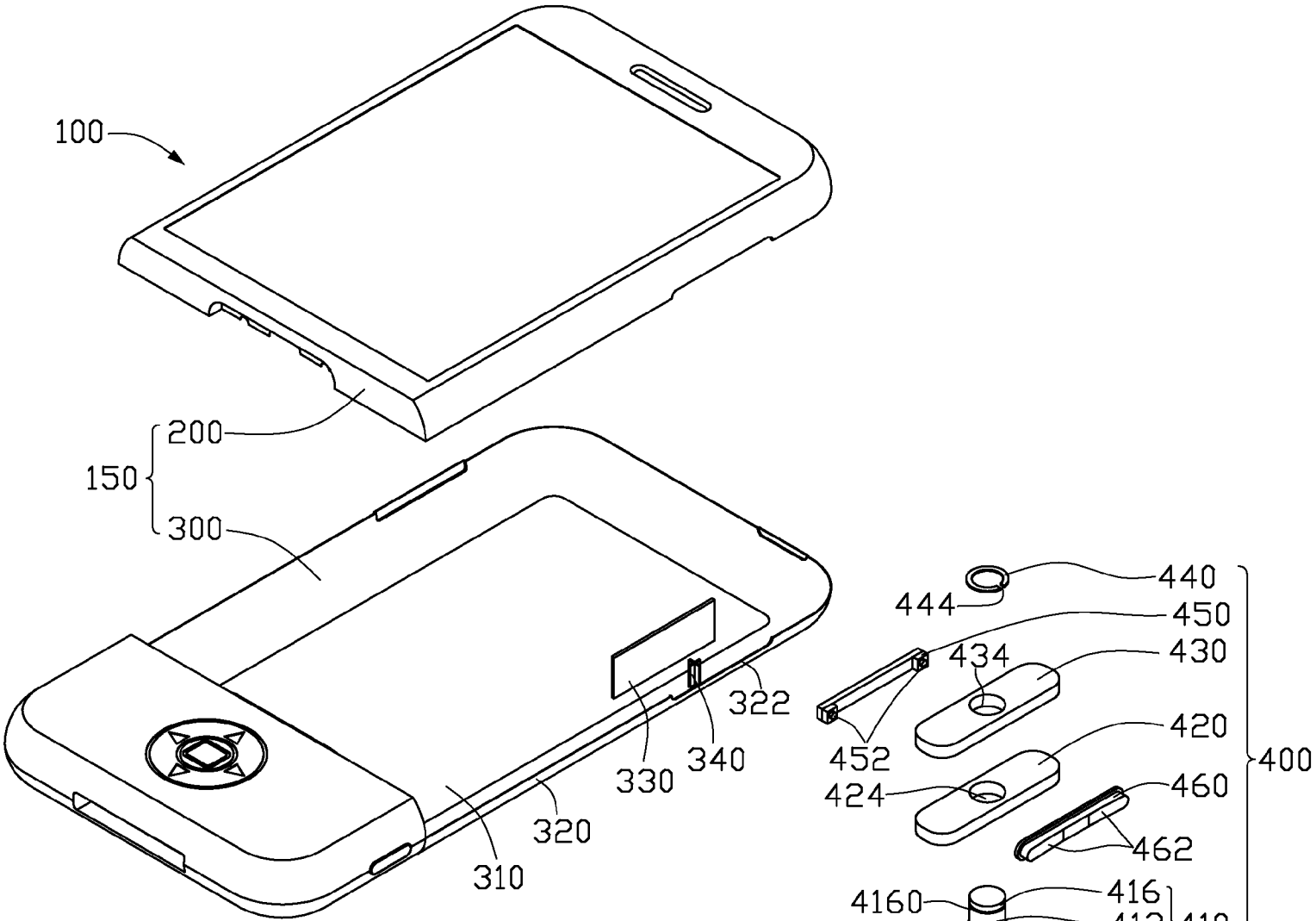
FIG. 4 is another completely exploded view of the electronic device in FIG. 1.

Referring to FIGS. 2 to 4, the main body 150 includes a first housing 200, and a second housing 300 engaged with the first housing 200. The first housing 200 has a first surface 210, a second surface 220 extending from the first surface 210, a receiving portion 230 arranged on the first surface 210, and two supporting portion 240 received in the receiving portion 230.

The second surface 220 is substantially perpendicular to the first surface 210. The second surface 220 defines a first notch 222 at an edge away from the first surface 210.

The receiving portion 230 is substantial strip shaped. The receiving portion 230 is adjacent to the second surface 220.

The two supporting portions 240 are symmetrical to each other. Each of the supporting portions may be an L-shaped plate perpendicularly extending from the first surface 210.

The second housing 300 has a base surface 310 opposite to the first surface 210, a side surface 320 extending from a side edge of the base surface 310 toward the second surface 220, a fixing portion 330, and a contacting portion 340. Both of the fixing portion 330 and the contacting portion 340 are disposed on the base surface 310 and adjacent to the side surface 320. The side surface 320 defines a second notch 322 at a bottom edge which is away from the base surface 310.

The fixing portion 330 is substantially perpendicular to the base surface 310. The fixing portion 330 may be a plate parallel with the side surface 320. The contacting portion 340 is located between the side surface 320 and the fixing portion 330 and corresponds to the second notch 322.

The input key structure 400 includes a shaft 410, a first magnetic body 430, a second magnetic body 420, a blocking member 440, an input key 460, and a circuit board 450. Both of the second magnetic body 420 and the first magnetic body 430 are sleeved on the shaft 410. The circuit board 450 and the input key 460 are disposed at opposite sides of the second magnetic body 420.

The shaft 410 includes a rod 412, a rim 414 and a restricting portion 416. The rim 414 and the restricting portion 416 are arranged on opposite ends of the rod 412. The rim 414 has a diameter larger than that of the rod 412 so as to protrude from a periphery of the rod 410. The restricting portion 416 defines a slot 4160 on its periphery.

The second magnetic body 420 is substantial strip shaped. The second magnetic body 420 defines a first hole 424 in the center thereof. The first magnetic body 430 has a similar structure with the second magnetic body 420. The first magnetic body 430 is substantial strip shaped, and defines a second hole 434 in the center thereof.

The shaft 410 passes through the second magnetic body 420 and the first magnetic body 430. The first magnetic body 430 is parallel to the second magnetic body 420. Surfaces facing each other of the second magnetic body 420 and the first magnetic body 430 have different polarities, thus a magnetic attractive force is generated between the second magnetic body 420 and the first magnetic body 430.

The blocking member 440 is substantially ring shaped. The blocking member defines a gap 444.

The circuit board 450 has two switches 452 on opposite ends thereof. The two switches 452 face opposite ends of the second magnetic body 420 correspondingly. The switch 452 has two states; an open state and a close state.

The input key 460 has two pressing portion 462 on opposite ends. The two pressing portions 462 are corresponding to the opposite ends of the second magnetic body 420.

In assembly, The shaft 410 passes through the first hole 424 of the second magnetic body 420 and the second hole 434 of the first magnetic body 430, then the blocking member 440 is sleeved in the slot 4160 of the restricting portion 416, thus the second magnetic body 420 and the first magnetic body 430 are sandwiched between the rim 414 and the blocking member 440.

Then, the circuit board 450 is fixed on the fixing portion 330 via a kind of traditional fixing modes such as rivet joints. The input key 460 is fixed on the second magnetic body 420 via a kind of traditional fixing modes such as bonding. The first magnetic body 430 is received and secured in the receiving portion 230. The supporting portions 240 support the first magnetic body 430. The first housing 200 is engaged with the second housing 300 to assemble into the electronic device 100, meanwhile, the contacting portion 340 contacts the second magnetic body 420, thus the second magnetic body 420 and the first magnetic body 430 are sandwiched between the supporting portions 240 and the contacting portion 340. The second magnetic body 420 is parallel to the first magnetic body 430 via the attractive force generated between the second magnetic body 420 and the first magnetic body 430. The input key 460 protrudes out of the main body 150 via the through hole formed by the second notch 322 integrating with the first notch 222.

Figure 5:
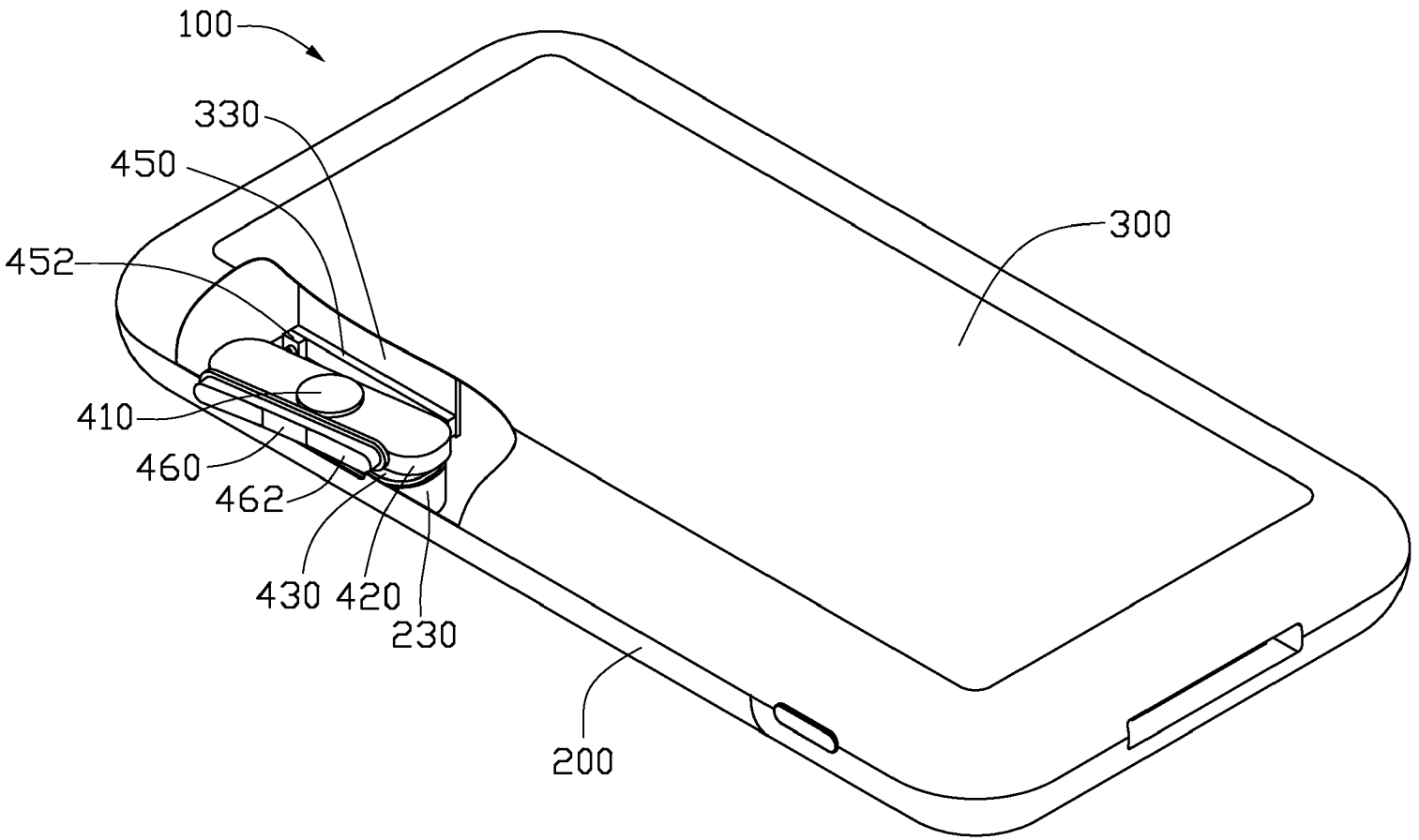
FIG. 5 is a schematic view of the electronic device in FIG. 1 during use.

Referring to FIG. 5, in use, the second magnetic body 420 can rotate relative to the first magnetic body 430 to selectively locate between an initial position and a target position. In the initial position, the second magnetic body 420 is parallel to the first magnetic body 430; and the switch 452 is in the open state. In the target position, the second magnetic body 420 is rotated away from the initial position and contacts with one of the switches 452; and the contacted switch 452 is in the closed state.

When an external force is exerted on one of the pressing portions 462, the input key 460 rotates and drives the second magnetic body 420 to rotate relative to the first magnetic body 430 until that the second magnetic body 420 contacts one of the switches 452. The second magnetic body 420 rotates from the initial position to the target position. The contacted switch 452 changes from the open state to the close state.

When the external force is released, the attractive force generated between the second magnetic body 420 and the first magnetic body 430 drives the second magnetic body 420 to return to the initial position; and the contacted switch 452 changes from the close state to the open state. The second magnetic body 420 and the first magnetic body 430 are still functional after repetitious use. Therefore, a reliability of the electronic device 100 is improved.

It is to be understood, however, that even though numerous information and advantages of the present embodiments have been set forth in the foregoing description, together with details of the structures and functions of the present embodiments, the disclosure is illustrative only; and that changes may be made in detail, especially in matters of shape, size, and arrangement of parts within the principles of the present embodiments to the full extent indicated by the broad general meaning of the terms in which the appended claims are expressed.

What is claimed is:

1. An input key structure for an electronic device comprising:

a first magnetic body;

a circuit board with a switch; and a second magnetic body rotatable with respect to the first magnetic body to selectively locate between an initial position parallel with the first magnetic body and a target position contacted with the switch; wherein the second magnetic body is structured to cooperate with the first magnetic body to generate a magnetic attractive force to automatically adjust the second magnetic body to the initial position when the second magnetic body is rotated away from its initial position to the target position;

a shaft being insertable into the first magnetic body and the second magnetic body;

wherein the shaft comprises a rod, a rim and a restricting portion arranged on opposite ends of the rod; the rim protrudes from a periphery of the rod, the restricting portion defines a slot, the input key structure further comprises a blocking member sleeved in the slot of the restricting portion, and the first magnetic body and the second magnetic body are sandwiched between the rim and the blocking member; and an input key; the input key and the circuit board being arranged at opposite sides of the second magnetic body.

2. The input key structure according to claim 1, wherein surfaces facing each other, of the first magnetic body and the second magnetic body, have different polarities.

3. The input key structure according to claim 1, wherein the blocking member is ring shaped.

4. The input key structure according to claim 3, wherein the blocking member defines a gap.

5. The input key structure according to claim 1, wherein the electronic device comprises a main body with a through hole, and the input key protrudes out of the main body via the through hole.

6. The input key structure according to claim 1, wherein the electronic device comprises a main body; and the main body has a receiving portion for accommodating and securing the first magnetic body.

7. The input key structure according to claim 1, wherein the electronic device comprises a first housing and a second housing engaged with the first housing, the first housing has a supporting portion, the second housing has a contacting portion, and the first magnetic body and the second magnetic body are sandwiched between the supporting portion and the contacting portion.

8. An input key structure for an electronic device comprising:

a first magnetic body;

a second magnetic body parallel to the first magnetic body; and a circuit board with at least one switch facing the second magnetic body, the switch having an open state and a close state;

wherein the second magnetic body is capable of rotating with respect to the first magnetic body to actuate the switch to selectively be in close state and the open state;

wherein surfaces facing each other, of the first magnetic body and the second magnetic body, have different polarities, and a magnetic attractive force generated between the first magnetic body and the second magnetic body actuates the at least one switch to be in the open state from the close state;

an input key; the input key and the circuit board being arranged at opposite sides of the second magnetic body; and a shaft being insertable into the first magnetic body and the second magnetic body; wherein the shaft comprises a rod, a rim and a restricting portion arranged on opposite ends of the rod; the rim protrudes from a periphery of the rod, the restricting portion defines a slot, the input key structure further comprises a blocking member sleeved in the slot of the restricting portion, and the first magnetic body and the second magnetic body are sandwiched between the rim and the blocking member.

9. The input key structure according to claim 8, wherein the at least one switch are two switches, the two switches face the opposite ends of the second magnetic body correspondingly.

10. An input key structure for an electronic device comprising:

a first magnetic body being strip shaped;

a second magnetic body parallel to the first magnetic body; surfaces facing each other, of the first magnetic body and the second magnetic body having different polarities;

an input key fixed on the second magnetic body having two pressing portion corresponding to opposite ends of the second magnetic body;

a circuit board with two switches facing the opposite ends of the second magnetic body, the input key and the circuit board being disposed at opposite sides of the second magnetic body; and a shaft being insertable into the first magnetic body and the second magnetic body; wherein the shaft comprises a rod, a rim and a restricting portion arranged on opposite ends of the rod; the rim protrudes from a periphery of the rod, the restricting portion defines a slot, the input key structure further comprises a blocking member sleeved in the slot of the restricting portion, and the first magnetic body and the second magnetic body are sandwiched between the rim and the blocking member.

11. The input key structure according to claim 10, wherein the blocking member defines a gap.

12. The input key structure according to claim 10, wherein the electronic device further comprises a main body, and the main body has a receiving portion for accommodating and securing the first magnetic body.

13. The input key structure according to claim 10, wherein the electronic device comprises a first housing and a second housing engaged with the first housing, the first housing has a supporting portion, the second housing has a contacting portion, and the first magnetic body and the second magnetic body are sandwiched between the supporting portion and the contacting portion.

* * * * *